US011451898B2

(12) United States Patent
Sapozhnykov et al.

(10) Patent No.: US 11,451,898 B2
(45) Date of Patent: Sep. 20, 2022

(54) HEADSET ON EAR STATE DETECTION

(71) Applicant: Cirrus Logic International Semiconductor Ltd., Edinburgh (GB)

(72) Inventors: Vitaliy Sapozhnykov, Cheltenham (AU); Thomas Ivan Harvey, Northcote (AU); Nafiseh Erfaniansaeedi, Victoria (AU); Robert Luke, Victoria (AU)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 17/001,997

(22) Filed: Aug. 25, 2020

(65) Prior Publication Data

US 2020/0389717 A1 Dec. 10, 2020

Related U.S. Application Data

(63) Continuation of application No. 16/131,299, filed on Sep. 14, 2018, now Pat. No. 10,812,889.

(60) Provisional application No. 62/570,374, filed on Oct. 10, 2017.

(51) Int. Cl.
*H04R 1/10* (2006.01)
*H04R 29/00* (2006.01)

(52) U.S. Cl.
CPC ..... *H04R 1/1041* (2013.01); *H04R 1/1008* (2013.01); *H04R 1/1091* (2013.01); *H04R 29/001* (2013.01); *H04R 2460/03* (2013.01); *H04R 2460/15* (2013.01)

(58) Field of Classification Search
CPC .. H04R 1/1008; H04R 1/1041; H04R 1/1091; H04R 29/001; H04R 2460/03; H04R 2460/15
See application file for complete search history.

(56) References Cited

U.S. PATENT DOCUMENTS

| | | | |
|---|---|---|---|
| 7,406,179 | B2 | 7/2008 | Ryan |
| 2008/0137873 | A1 | 6/2008 | Goldstein |
| 2009/0080670 | A1 | 3/2009 | Solbeck et al. |
| 2011/0158419 | A1 | 6/2011 | Theverappuruma et al. |
| 2014/0093090 | A1* | 4/2014 | Bajic ..... H04R 3/04 381/74 |
| 2015/0124977 | A1 | 5/2015 | Srivastava et al. |
| 2017/0013345 | A1 | 1/2017 | Kumar et al. |
| 2017/0139669 | A1 | 5/2017 | Oh et al. |

(Continued)

FOREIGN PATENT DOCUMENTS

WO 2018081154 A1 5/2018

OTHER PUBLICATIONS

Paleologu, C., et al., Study of the General Kalman Filter for Echo Cancellation, IEEE Transactions on Audio, Speech, and Language Processing, vol. 21, No. 8, Aug. 2013, pp. 1539-1549.

*Primary Examiner* — Daniel R Sellers
(74) *Attorney, Agent, or Firm* — Jackson Walker L.L.P.

(57) ABSTRACT

A method and device for detecting whether a headset is on ear. A probe signal is generated for acoustic playback from a speaker. A microphone signal from a microphone is received, the microphone signal comprising at least a portion of the probe signal as received at the microphone. The microphone signal is passed to a state estimator, to produce an estimate of at least one parameter of the portion of the probe signal contained in the microphone signal. The estimate of the at least one parameter is processed to determine whether the headset is on ear.

20 Claims, 7 Drawing Sheets

(56) References Cited

U.S. PATENT DOCUMENTS

2018/0115815 A1* 4/2018 Kumar ..... H04R 3/00
2018/0249266 A1* 8/2018 Termeulen ..... H04R 1/1083

* cited by examiner

HEADSET ON EAR STATE DETECTION

This application is a continuation of U.S. Nonprovisional patent application Ser. No. 16/131,299, filed Sep. 14, 2018, which claims priority to U.S. Provisional Patent Application Ser. No. 62/570,374, filed Oct. 10, 2017, each of which is incorporated by reference herein in its entirety.

FIELD OF THE INVENTION

The present invention relates to headsets, and in particular to a headset configured to determine whether or not the headset is in place on or in the ear of a user, and a method for making such a determination.

BACKGROUND OF THE INVENTION

Headsets are a popular device for delivering sound to one or both ears of a user, such as playback of music or audio files or telephony signals. Headsets typically also capture sound from the surrounding environment, such as the user's voice for voice recording or telephony, or background noise signals to be used to enhance signal processing by the device. Headsets can provide a wide range of signal processing functions.

For example, one such function is Active Noise Cancellation (ANC, also known as active noise control) which combines a noise cancelling signal with a playback signal and outputs the combined signal via a speaker, so that the noise cancelling signal component acoustically cancels ambient noise and the user only or primarily hears the playback signal of interest. ANC processing typically takes as inputs an ambient noise signal provided by a reference (feed-forward) microphone, and a playback signal provided by an error (feed-back) microphone. ANC processing consumes appreciable power continuously, even if the headset is taken off.

Thus in ANC, and similarly in many other signal processing functions of a headset, it is desirable to have knowledge of whether the headset is being worn at any particular time. For example, it is desirable to know whether on-ear headsets are placed on or over the pinna(e) of the user, and whether earbud headsets have been placed within the ear canal(s) or concha(e) of the user. Both such use cases are referred to herein as the respective headset being "on ear". The unused state, such as when a headset is carried around the user's neck or removed entirely, is referred to herein as being "off ear".

Previous approaches to on ear detection include the use of dedicated sensors such as capacitive, optical or infrared sensors, which can detect when the headset is brought onto or close to the ear. However, to provide such non-acoustic sensors adds hardware cost and adds to power consumption. Another previous approach to on ear detection is to provide a sense microphone positioned to detect acoustic sound inside the headset when worn, on the basis that acoustic reverberation inside the ear canal and/or pinna will cause a detectable rise in power of the sense microphone signal as compared to when the headset is not on ear. However, the sense microphone signal power can be affected by noise sources such as wind noise, and so this approach can output a false positive that the headset is on ear when in fact the headset is off ear and affected by noise. These and other approaches to on ear detection can also output false positives when the headset is held in the user's hand, placed in a box, or the like.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect the present invention provides a signal processing device for on ear detection for a headset, the device comprising:

a probe signal generator configured to generate a probe signal for acoustic playback from a speaker;

an input for receiving a microphone signal from a microphone, the microphone signal comprising at least a portion of the probe signal as received at the microphone; and a processor configured to apply state estimation to the microphone signal to produce an estimate of at least one parameter of the portion of the probe signal contained in the microphone signal, the processor further configured to process the estimate of the at least one parameter to determine whether the headset is on ear.

According to a second aspect the present invention provides a method for on ear detection for a headset, the method comprising:

generating a probe signal for acoustic playback from a speaker;

receiving a microphone signal from a microphone, the microphone signal comprising at least a portion of the probe signal as received at the microphone;

applying state estimation to the microphone signal to produce an estimate of at least one parameter of the portion of the probe signal contained in the microphone signal, and determining from the estimate of the at least one parameter whether the headset is on ear.

According to a third aspect the present invention provides a non-transitory computer readable medium for on ear detection for a headset, comprising instructions which, when executed by one or more processors, causes performance of the following:

generating a probe signal for acoustic playback from a speaker;

receiving a microphone signal from a microphone, the microphone signal comprising at least a portion of the probe signal as received at the microphone;

applying state estimation to the microphone signal to produce an estimate of at least one parameter of the portion of the probe signal contained in the microphone signal, and determining from the estimate of the at least one parameter whether the headset is on ear.

According to a fourth aspect the present invention provides a system for on ear detection for a headset, the system comprising a processor and a memory, the memory containing instructions executable by the processor and wherein the system is operative to:

generate a probe signal for acoustic playback from a speaker;

receive a microphone signal from a microphone, the microphone signal comprising at least a portion of the probe signal as received at the microphone;

apply state estimation to the microphone signal to produce an estimate of at least one parameter of the portion of the probe signal contained in the microphone signal, and determine from the estimate of the at least one parameter whether the headset is on ear.

In some embodiments of the invention the processor is configured to process the estimate of the at least one parameter to determine whether the headset is on ear by comparing the estimated parameter to a threshold.

In some embodiments of the invention the at least one parameter is an amplitude of the probe signal. When the amplitude is above a threshold, in some embodiments the processor is configured to indicate that the headset is on ear.

In some embodiments of the invention the probe signal comprises a single tone. In other embodiments of the invention the probe signal comprises a weighted multitone signal. In some embodiments of the invention the probe signal is confined to a frequency range which is inaudible. In some embodiments of the invention the probe signal is confined to a frequency range which is less than a threshold frequency below the range of typical human hearing. In some embodiments of the invention the probe signal is varied over time. For example, the probe signal might be varied in response to a changed level of ambient noise in the frequency range of the probe signal.

Some embodiments of the invention may further comprise a down converter configured to down convert the microphone signal prior to the state estimation, to reduce a computational burden required for the state estimation.

In some embodiments of the invention a Kalman filter effects the state estimation. In such embodiments a copy of the probe signal generated by the probe signal generator may be passed to a predict module of the Kalman filter.

In some embodiments of the invention a decision device module is configured to generate from the at least one parameter a first probability that the headset is on ear, and a second probability that the headset is off ear, and the processor is configured to use the first probability and/or the second probability to determine whether the headset is on ear. The decision device module in such embodiments may compare the at least one parameter to an upper threshold level to determine the first probability. In some embodiments the state estimation produces sample-by-sample estimates of the at least one parameter, and the estimates are considered on a frame basis to determine whether the headset is on ear, each frame comprising N estimates, and for each frame the first probability is calculated as $N_{ON}/N$, where $N_{ON}$ is the number of samples in that frame for which the at least one parameter exceeds the upper threshold.

In some embodiments of the invention the decision device module may compare the at least one parameter to a lower threshold level to determine the second probability. In some embodiments the state estimation produces sample-by-sample estimates of the at least one parameter, and wherein the estimates are considered on a frame basis to determine whether the headset is on ear, each frame comprising N estimates, and wherein for each frame the second probability is calculated as $N_{OFF}/N$, where $N_{OFF}$ is the number of samples in that frame for which the at least one parameter is less than the lower threshold.

In some embodiments of the invention the decision device module is configured to generate from the at least one parameter an uncertainty probability reflecting an uncertainty as to whether the headset is on ear or off ear, and the processor is configured to use the uncertainty probability to determine whether the headset is on ear. In some embodiments the state estimation may produce sample-by-sample estimates of the at least one parameter, and wherein the estimates are considered on a frame basis to determine whether the headset is on ear, each frame comprising N estimates, and wherein for each frame the uncertainty probability is calculated as $N_{UNC}/N$, where $N_{UNC}$ is the number of samples in that frame for which the at least one parameter is greater than the lower threshold and less than the upper threshold. In some such embodiments the processor may be configured to make no change to a previous determination as to whether the headset is on ear when the uncertainty probability exceeds an uncertainty threshold.

In some embodiments of the invention changes in the determination as to whether the headset is on ear are made with a first decision latency from off ear to on ear, and are made with a second decision latency from on ear to off ear, the first decision latency being less than the second decision latency so as to bias the determination towards an on ear determination.

In some embodiments of the invention a level of the probe signal may be dynamically changed in order to compensate for varied headset occlusion. Such embodiments may further comprise an input for receiving a microphone signal from a reference microphone of the headset which captures external environmental sound, and wherein the processor is further configured to apply state estimation to the reference microphone signal to produce a second estimate of the at least one parameter of the probe signal, and wherein the processor is further configured to compare the second estimate to the estimate to differentiate ambient noise from on ear occlusion.

In some embodiments of the invention the system is a headset, such as an earbud. In some embodiments an error microphone is mounted upon the headset such that it senses sounds arising within a space between the headset and a user's eardrum when the headset is worn. In some embodiments a reference microphone is mounted upon the headset such that it senses sounds arising externally of the headset when the headset is worn. In some embodiments of the invention the system is a smart phone or other such master device interoperable with the headset.

BRIEF DESCRIPTION OF THE DRAWINGS

An example of the invention will now be described with reference to the accompanying drawings, in which.

Corresponding reference characters indicate corresponding components throughout the drawings.

DETAILED DESCRIPTION OF PREFERRED EMBODIMENTS

Figure 1A:
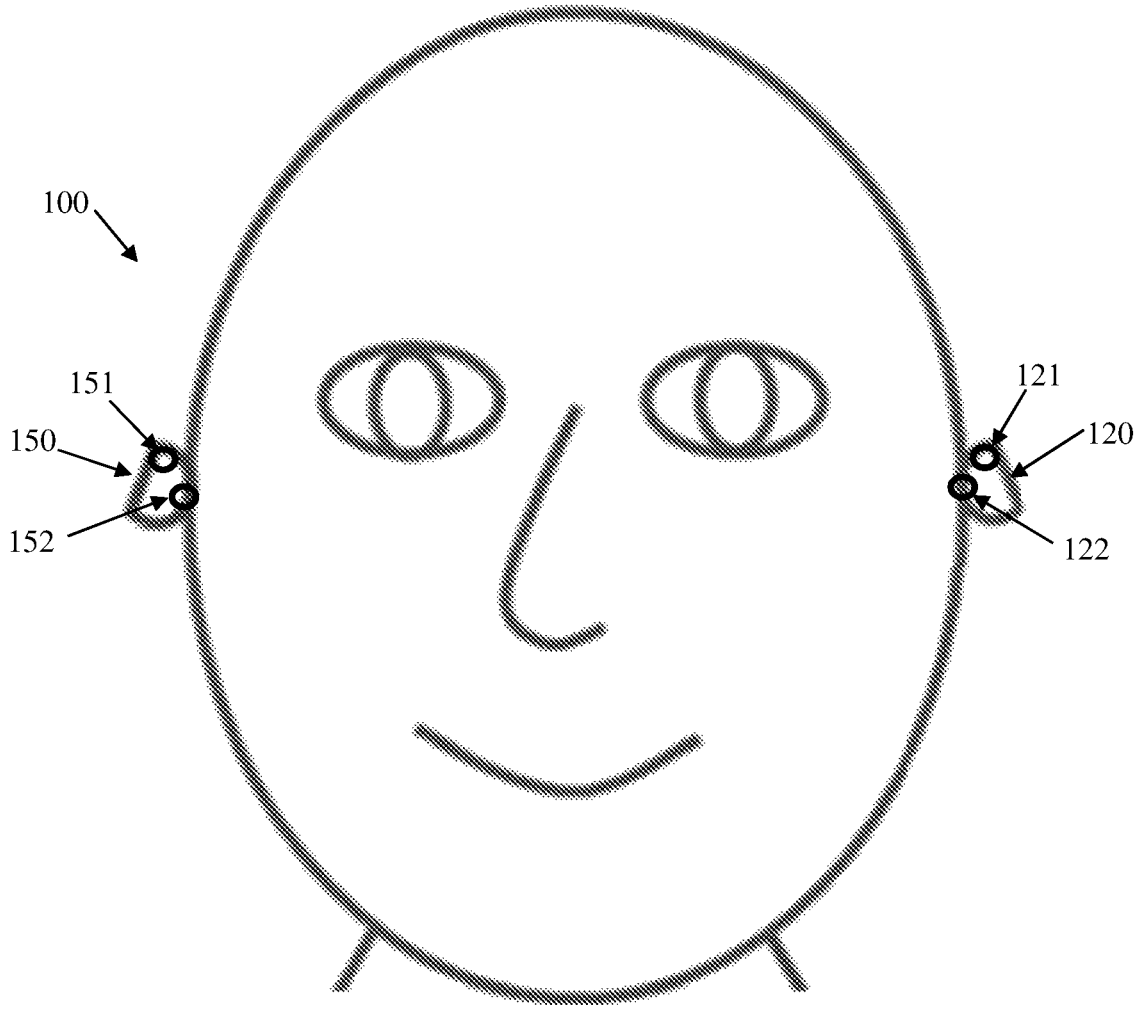
FIG. 1*a* and FIG. 1*b* illustrate a signal processing system comprising a wireless earbuds headset, in which on ear detection is implemented.
Figure 1B:
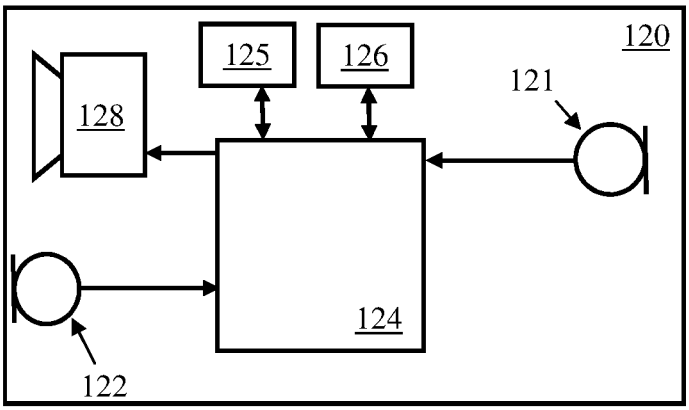

FIGS. 1*a* and 1*b* illustrate an ANC headset 100 in which on ear detection is implemented. Headset 100 comprises two wireless earbuds 120 and 150, each comprising two microphones 121, 122 and 151, 152, respectively. FIG. 1*b* is a system schematic of earbud 120. Earbud 150 is configured in substantially the same manner as earbud 120 and is thus not separately shown or described. A digital signal processor 124 of earbud 120 is configured to receive microphone signals from earbud microphones 121 and 122. Microphone 121 is a reference microphone and is positioned so as to sense ambient noise from outside the ear canal and outside of the earbud. Conversely, microphone 122 is an error microphone and in use is positioned inside the ear canal so as to sense acoustic sound within the ear canal including the output of speaker 128. When earbud 120 is positioned within the ear canal, microphone 122 is occluded to some extent from the external ambient acoustic environment, but remains well coupled to the output of speaker 128, whereas at such times microphone 121 is occluded to some extent from the output of speaker 128 but remains well coupled to the external ambient acoustic environment. Headset 100 is configured for a user to listen to music or audio, to make telephone calls, and to deliver voice commands to a voice recognition system, and other such audio processing functions.

Processor 124 is further configured to adapt the handling of such audio processing functions in response to one or both earbuds being positioned on the ear, or being removed from the ear. Earbud 120 further comprises a memory 125, which may in practice be provided as a single component or as multiple components. The memory 125 is provided for storing data and program instructions. Earbud 120 further comprises a transceiver 126, which is provided for allowing the earbud 120 to communicate wirelessly with external devices, including earbud 150. Such communications between the earbuds may in alternative embodiments comprise wired communications where suitable wires are provided between left and right sides of a headset, either directly such as within an overhead band, or via an intermediate device such as a smartphone. Earbud 120 further comprises a speaker 128 to deliver sound to the ear canal of the user. Earbud 120 is powered by a battery and may comprise other sensors (not shown).

Figure 2:
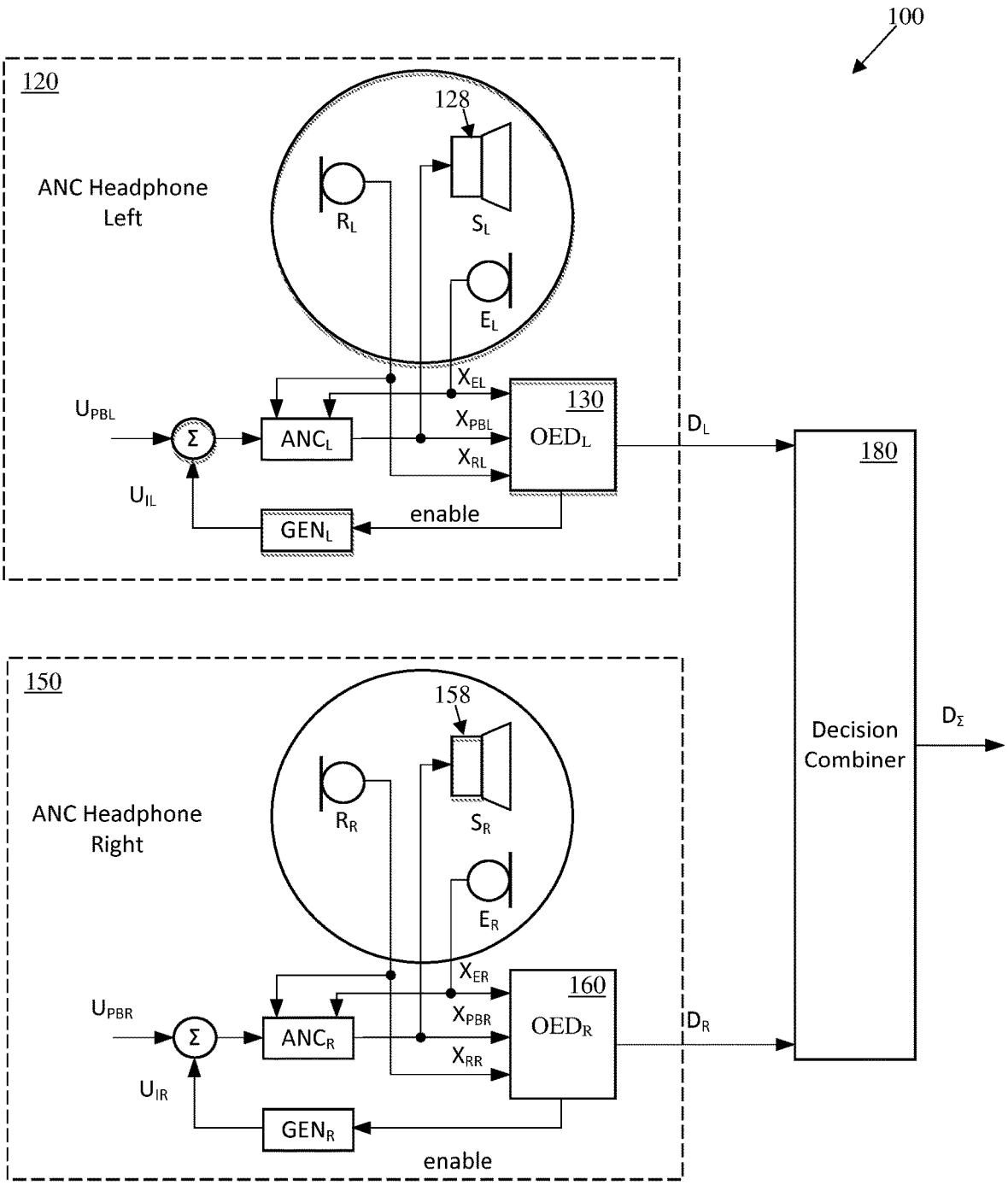
FIG. 2 is a generalised schematic of an ANC headset with the proposed on ear detector.

FIG. 2 is a generalised schematic of the ANC headset 100, illustrating in more detail the process for on ear detection in accordance with an embodiment of the present invention. In the following, the left reference microphone 121 is also denoted $R_L$, while the right reference microphone 151 is also denoted $R_R$. The left and right reference microphones respectively generate signals $X_{RL}$ and $X_{RR}$. The left error microphone 122 is also denoted $E_L$, while the right error microphone 152 is also denoted $E_R$, and these two error microphones respectively generate signals $X_{EL}$ and $X_{ER}$. The left earbud speaker 128 is also denoted $S_L$, and the right earbud speaker 158 is also denoted $S_R$. The left earbud playback audio signal is denoted $U_{PBL}$, and the right earbud playback audio signal is denoted $U_{PBR}$.

In accordance with the present embodiment of the invention, processor 124 of earbud 120 executes an on ear detector 130, or $OED_L$, in order to acoustically detect whether the earbud 120 is on or in the ear of the user. Earbud 150 executes an equivalent $OED_R$ 160. In this embodiment, the output of the respective on ear detector 130, 160 is passed as an enable or disable signal to a respective acoustic probe generator $GEN_L$, $GEN_R$. When enabled, the acoustic probe generator creates an inaudible acoustic probe signal $U_{IL}$, $U_{IR}$, to be summed with the respective playback audio signal. The output of the respective on ear detector 130, 160 is also passed as a signal $D_L$, $D_R$ to a Decision Combiner 180 which produces an overall on ear decision $D_\Sigma$.

In the following, i is used to denote L [left] or R [right], and it is to be understood that the described processes may operate in one headset only, in both headsets independently, or in both headsets interoperably, in accordance with various embodiments of the present invention. As shown in FIG. 2, each headphone is equipped with a speaker, $S_i$, a reference microphone, $R_i$, and an error microphone, $E_i$. To playback signal $U_{PBi}$, from a host playback device, there may be added an inaudible probe signal, $U_{Ii}$, depending on the value of the "enable" flag from the Control module: 1—add the probe; 0—do not add the probe. The inaudible probes, $U_{Ii}$, are generated by corresponding probe generators, $GEN_i$. A particular value of the "enable" flag, 0 or 1, depends on factors such as the device's operational environment conditions, ambient noise level, presence of playback, headset design, and other such factors. The resulting signal passes through the $ANC_i$, which provides the usual ANC function of adding a signal which constitutes a certain amount of estimated unwanted noise in antiphase. To this end, the $ANC_i$ takes inputs from the reference microphone, $R_i$, and error microphone, $E_i$. The output of the $ANC_i$ is then passed to the speaker $S_i$ to be played into the ear of the user. Thus, the ANC requires the presence of the microphones 121 and 122 and the speaker 128, and the on ear detection solution of the present invention requires no additional microphones, speakers, or sensors. The output from the speaker generates signal $X_{Ri}$ which contains a certain amount of uncompensated noise in the i-th reference microphone; similarly, it generates signal $X_{Ei}$ in the i-th error microphone.

Figure 3:
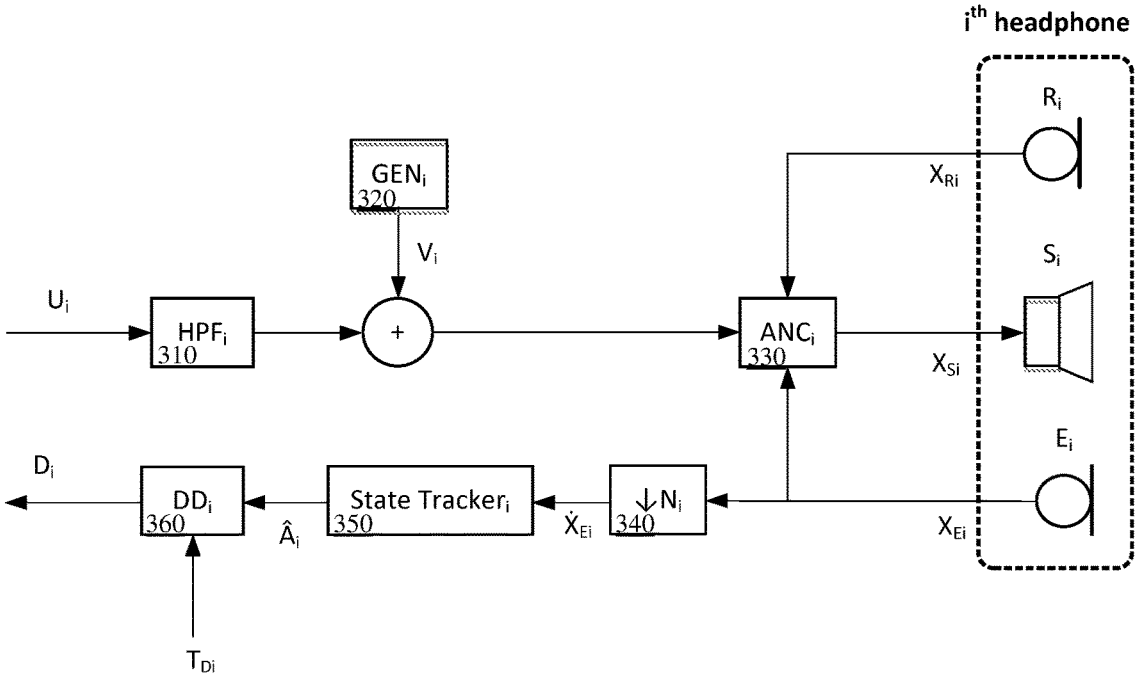
FIG. 3 is a more detailed block diagram of the ANC headset of FIG. 2, illustrating the state tracking on ear detector of the present invention in more detail.

FIG. 3 is a block diagram of the i-th headphone of the ANC headset 100 including an on ear detector in accordance with one embodiment of the present invention. Each headphone 120, 150 is equipped with a speaker, $S_i$, a reference microphone, $R_i$, and an error microphone, $E_i$. A playback signal, $U_i$, from a host playback device is summed together with an inaudible probe signal, $V_i$, which is generated by a corresponding probe generator, $GEN_i$ 320. The playback signal may be filtered with a high-pass filter, $HPF_i$ 310, in order to prevent spectral overlap between the playback content $U_i$ and the probe $V_i$. The signal resulting from the summation is passed to the $ANC_i$ 330 which provides the usual ANC function of adding a certain amount of estimated unwanted noise in antiphase. The signal $X_{Si}$ produced by the $ANC_i$ is passed to the speaker $S_i$ which acoustically plays back the signal. The output from the speaker $S_i$ generates a signal $X_{Ri}$ which contains a certain amount of uncompensated noise in the reference microphone $R_i$; similarly, it generates a signal $X_{Ei}$ in the error microphone $E_i$.

The error microphone signal, $X_{Ei}$, is down-converted to a necessary sampling rate in the down converter, $\downarrow N_i$ 340, and then is fed into the state tracker 350. The state tracker 350 performs state estimation to continuously estimate, or track, a selected parameter or parameters of the probe signal present in the down converted error microphone signal, $\dot{X}_{Ei}$. For example the state tracker 350 may track an amplitude of the probe signal present in the down converted error microphone signal, $\dot{X}_{Ei}$. The estimated probe signal parameter(s) $\hat{A}_i$ is/are passed to the decision device, DD 360, where a decision $D_i$ is produced as to whether or not the respective headphone is on ear. The individual decisions $D_i$ produced in this manner in both the left side and right side headphones may be used independently, or may be combined (e.g. ANDed) to produce the overall decision as to whether the respective headset is, or whether both headsets are, on ear.

The probe signal is made inaudible in this embodiment by being limited to having spectral content, $B_{IPS}$, which is situated below a nominal human audibility threshold, in this embodiment $B_{IPS} \leq 20$ Hz. In other embodiments the probe signal may occupy somewhat higher frequency components, without strictly being inaudible.

Importantly, in accordance with the present invention, the probe signal must take a form which can be tracked using state estimation, or state-space representation, to track the acoustic coupling of the probe signal from the playback speaker to the microphone. This is important because considerable noise may arise at the same frequency as the probe signal, such as wind noise. However, the present invention recognises that such noise typically has an incoherent variable phase and thus will tend not to corrupt or fool a state space estimator which is attuned to seek a known coherent signal. This is in contrast to simply monitoring a power in the band occupied by the probe signal, as such power monitoring will be corrupted by noise.

An example of the inaudible probe signal in accordance with one embodiment of the invention can be expressed as follows:

$$V_k = \Sigma_{n=1}^{N} w_n \cdot A_n \cos(\phi_n \cdot k) \tag{1}$$

$$\phi = 2\pi \frac{f_{on}}{f_s} \tag{2}$$

where N is the number of harmonic components; $w_n \in [0,1]$ is a weight of the corresponding component; $A_n$, $f_{0n}$, and $f_s$ are the amplitude, fundamental frequency, and sampling frequency respectively. For example, if N=1 and $w_1=1$ the probe signal is a cosine wave with amplitude A and frequency $f_0$. Many other suitable probe signals can be envisaged for use in other embodiments within the scope of the present invention.

The estimated amplitudes $\hat{A}_n$ (or a sum thereof, $\hat{A}_\Sigma$) output by the state tracker 350 may be used as an on ear detection feature. This may be effected by defining that a higher $\hat{A}_\Sigma$ value corresponds to the on ear state, because during this state more energy of the probe signal is captured by the error microphone due to occlusion of the ear canal and the constraint of the speaker output within the ear canal. Conversely, a lower $\hat{A}_\Sigma$ value may be defined as corresponding to the off ear state, because during this state more sound pressure of the probe signal output by the speaker escapes in free space without the constraint of the ear canal, and therefore less of the probe signal is captured by the error microphone.

In the following a single component probe is discussed for clarity, however it is to be appreciated that other embodiments of the invention can equivalently utilise a weighted multitone probe as per EQ1, or any other probe representable by state-space model, within the scope of the present invention.

We now omit the index i for clarity, and introduce k to denote samples. It is important to note that for a given $n^{th}$ fundamental frequency, $f_0$, the probe $V_k$ can be generated recursively as follows:

$$\begin{bmatrix} V_{1,k} \\ V_{2,k} \end{bmatrix} = \begin{bmatrix} \cos(\phi) & -\sin(\phi) \\ \sin(\phi) & \cos(\phi) \end{bmatrix} \begin{bmatrix} V_{1,k-1} \\ V_{2,k-1} \end{bmatrix} \tag{3}$$

where $V_{1,k}$ is the in-phase (cosine) component at a time instance k, $V_{2,k}$ is the quadrature (sine) component at a time instance k, $V_{1,k-1}$ is the in-phase (cosine) component at a time instance k−1, $V_{2,k-1}$ is the quadrature (sine) component at a time instance k−1, and $\phi$ is defined by EQ2.

The amplitude of the generated probe is defined by the initial state vector $\vec{v}_0=[V_{1,0}\ V_{2,0}]^T$ and may be calculated as given below:

$$A_k = \sqrt{V_{1,k}^2 + V_{2,k}^2} \tag{4}$$

In matrix form, EQ3 can be written as $$\begin{aligned} &\vec{v}_k = \Phi \cdot \vec{v}_{k-1}, \\ &\vec{v}_k = [V_{1,k} V_{2,k}]^T, \vec{v}_{k-1} = [V_{1,k-1} V_{2,k-1}]^T, \\ &\Phi = \begin{bmatrix} \cos(\phi) & -\sin(\phi) \\ \sin(\phi) & \cos(\phi) \end{bmatrix}. \end{aligned} \tag{5}$$

Each $n^{th}$ component in EQ1 has a dedicated recursive generator matrix $\Phi_n$.

Other types of recursive quadrature generators are possible. The quadrature generator described by EQ3 is given only as an example.

In this embodiment, the HPF 310 filters the input audio in order to prevent spectral overlap between the playback content and the probe. For example, if the probe is a cosine wave (EQ1, N=1) with the frequency $f_0$=20 Hz, then the cut-off frequency of the HPF should be chosen such that $f_0$ is not affected by the HPF stop-band attenuation. Again, alternative embodiments within the scope of the present invention may utilise a higher cutoff frequency, as permitted by the intended use and noting that such filtering will remove the low frequency components of the playback signal of interest which may become undesirable.

The probe generator, GEN 320, generates an inaudible probe signal, whose spectral content is situated below a nominal human audibility threshold. One example considered here is that the probe signal is a cosine wave of amplitude A and fundamental frequency $f_0$ as given by EQ1 (N=1, $w_1$=1).

The inaudible probe may be a continuous stationary signal or its parameters may vary with time, while remaining a suitable signal within the scope of the present invention. The properties of the probe signal (e.g. number of components N, frequency $f_{0n}$, amplitude $A_n$, spectral shape $w_n$) may be varied depending on a preconfigured sequence or in response to the signals on the other sensors. For example, if a large amount of ambient noise arises at the same frequencies as the probe, the probe signal may be adjusted by GEN 320 to change the probe frequency or any of the probe signal parameters (amplitude, frequency, spectral shape, and others) in order to maintain the probe signal cleanly observable even in the presence of such ambient noise.

The probe generator GEN 320 may be implemented as a hardware tone/multi-tone generator, a recursive software generator, a look-up table, and any other suitable means of signal generation.

Turning again to the down converter ↓N 340, it is noted that the spectral content of the error microphone signal above the highest $f_{0n}$ is unnecessary for on-ear detection, which must only consider the low frequency band occupied by the probe signal. Accordingly, in this embodiment the error microphone signal sampling rate, $f_s$, is first down converted by the down converter ↓N 340 in order to reduce the computational burden added by on ear detection, and further to decrease the power consumption of the on ear detector. The down converter ↓N 340 may be implemented as a low-pass filter (LPF) followed by a down-sampler. For example, the sampling frequency of the on ear detector may be reduced to a value $f_s \geq 2*f_{0n}$ with LPF cut-off frequency and down-sampling ratio chosen accordingly. Naturally, the sampling rates of the probe generator 320 and the output of the down converter ↓N 340 should be the same. For $f_{0n}=20$ Hz it is recommended to use $f_s \in [60, 120]$ Hz.

Figure 4:
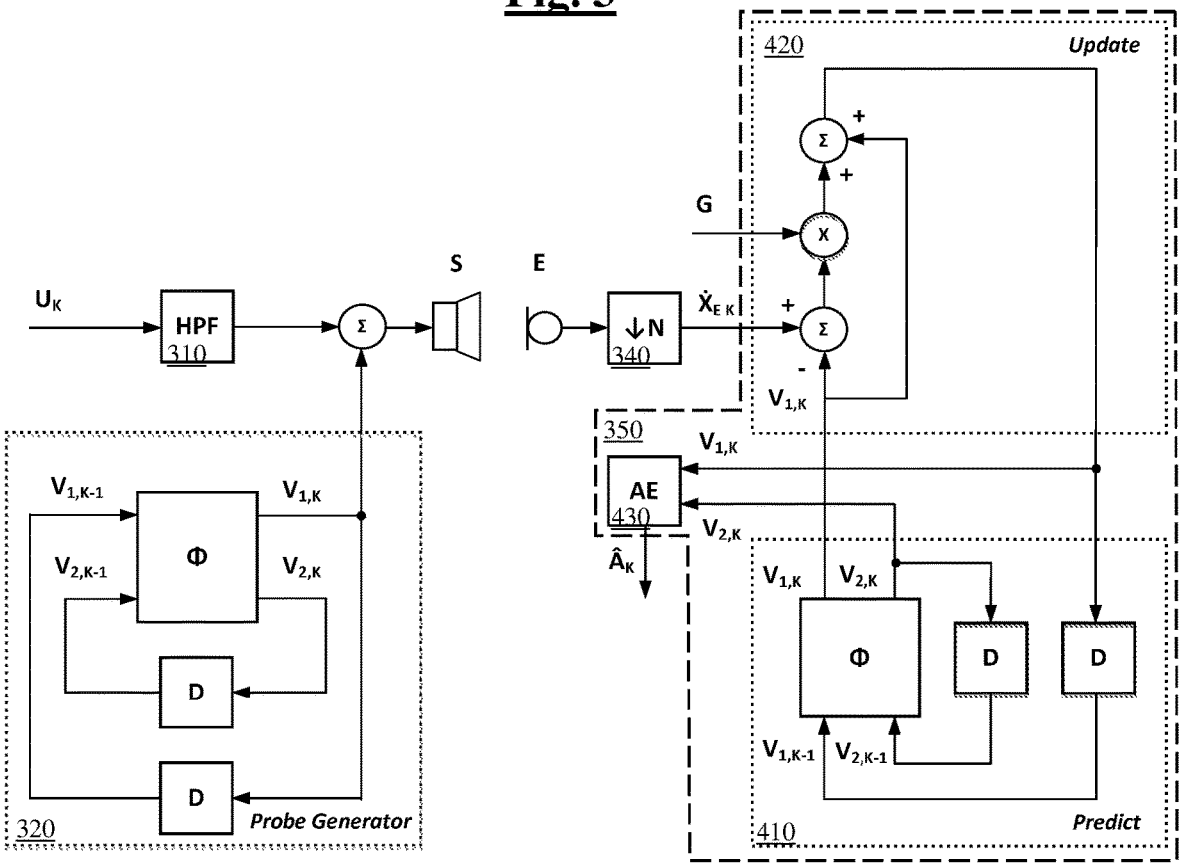
FIG. 4 is a block diagram of the Kalman amplitude tracker implemented by the on ear detector of FIGS. 2 and 3.

FIG. 4 illustrates the state tracker 350 in more detail. In this embodiment, the on ear state tracker 350 is based on a Kalman filter used as an amplitude estimator/tracker. Again, the playback audio signal is high-pass filtered at HPF 310 and then summed together with a probe signal $V_{1,K}$ generated by the probe generator 320. The resulting audio signal is played through the speaker S 128. It should be emphasised, that the inaudible probe does not have to be generated by the recursive generator, Φ (EQ5). It is shown to be so only to highlight the state-space nature of the approach adopted by the present invention. In practice, the probe $V_{1,K}$ may be generated by a hardware tone/multi-tone generator, recursive software generator, look-up table, or other suitable means.

The audio signal acoustically output by the speaker S 128 is captured by the error microphone, E 122, and after the rate reduction provided by down converter ↓N 340 the signal $\dot{X}_{EK}$ is input into the state tracker 350. The Kalman filter-based state tracker 350 comprises a "Predict" module 410 and an "Update" module 420. During the "Predict" step, the corresponding sub-module 410 re-generates the probe signal $V_{1,K}$ locally. Here also, the inaudible probe does not have to be generated by the recursive generator, Φ (EQ5), but is shown to be so to highlight the state-space nature of the approach adopted by the present invention. In other embodiments within the scope of the invention, the probe may be generated in module 410 by a hardware tone/multi-tone generator, recursive software generator, look-up table, and other.

The "Update" module 420 takes the down-converted error microphone signal $\dot{X}_{EK}$, and a local copy of the inaudible probe signal, $V_{1,K}$ provided by module 410, and implements a convex combination of the two:

$$V_{1,K}=V_{1,K}+G\cdot(\dot{X}_{EK}-V_{1,K}) \tag{6}$$

where G is the Kalman gain. The Kalman gain, G, may be calculated "on the fly" using Kalman filter theory, and is thus not further discussed. Alternatively, where the Kalman gain computations do not depend on the real-time data the gain G can be pre-computed to reduce real-time computational load.

After the predict/update steps are completed, the amplitude of the probe signal is estimated as per EQ4 by the Amplitude Estimator (AE 430).

Returning to FIG. 3, the estimated amplitude of the probe signal, $\hat{A}$, is fed to the decision device, DD 360, where it may be integrated from the current sampling rate to the required detection time resolution (a suitable time resolution value in one example being 200 ms) and compared to a pre-defined threshold, $T_D$ in order to produce the binary decision, D. In more detail, this step is effected as follows:

$$D=\begin{cases} 0, & \hat{A}_k < T_D \\ 1, & \hat{A}_k \geq T_D \end{cases}. \tag{7}$$

The Decision Device 360 is input with instantaneous (sample-by-sample) probe amplitude estimation from the Kalman amplitude tracker 350, and produces binary on ear decisions at the time resolution defined by $t_D$.

While the simple thresholding decision made by DD 360 in this embodiment may suffice in some applications, this may in some cases return a higher rate of false positive or false negative indications as to whether the headset is on ear, or may be overly volatile in alternating between an on ear decision and an off ear decision.

Accordingly the following embodiment of the invention is also presented, to provide a more sophisticated approach to the Decision Device 360 in order to improve the robustness and stability of the on ear detection output. The derivation of this solution is illustrated in the signal plots of FIGS. 5*a*-5*e*.

Figure 5A:
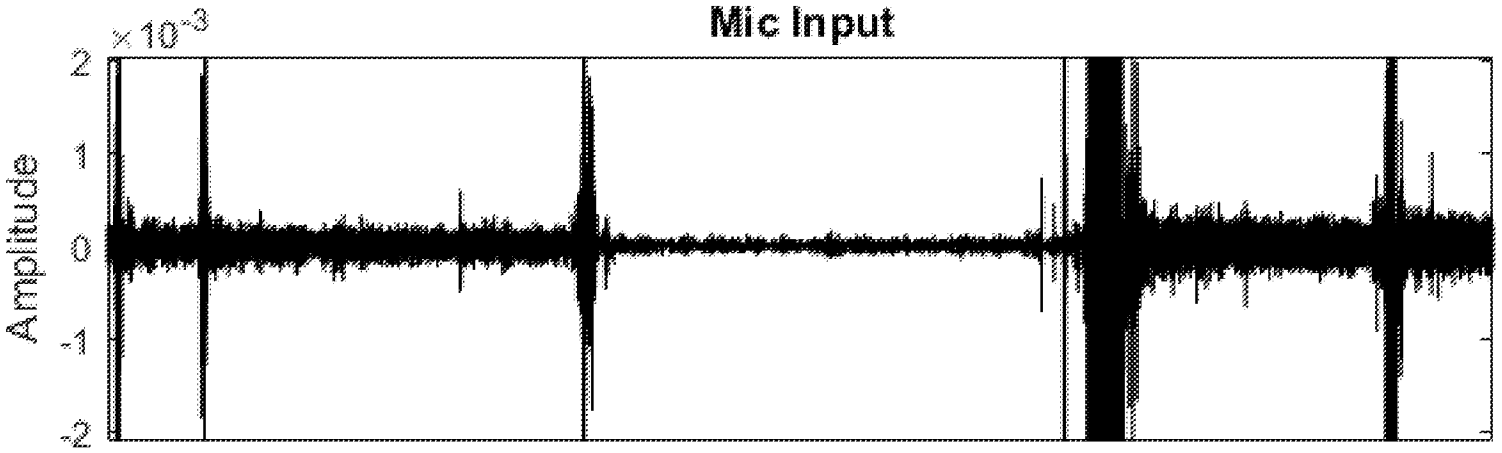
FIGS. 5*a*-5*e* illustrate the application of multiple decision thresholds and decision probabilities to improve stability of the on ear detector output.
Figure 5B:
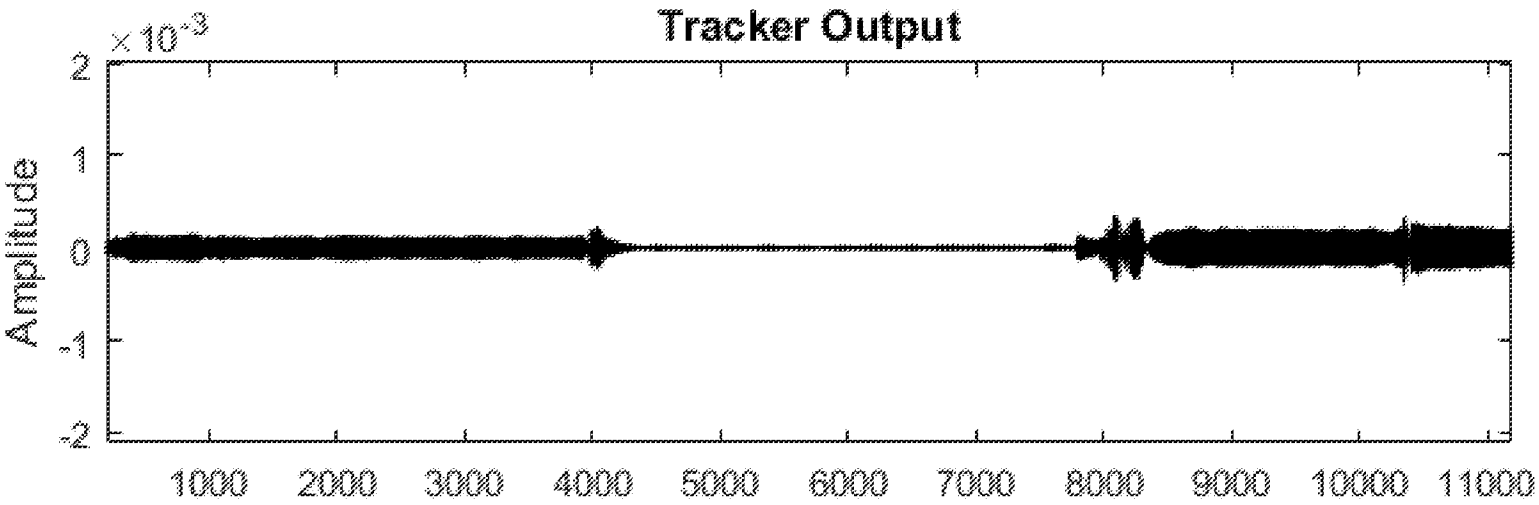

The testing scenario which produced the data of FIGS. 5*a*-5*e* comprised a LiSheng Headset with mould, in a public bar environment and with the user's own speech, and no playback audio. The probe signal used comprised a 20 Hz tone producing 66 dB SPL. ANC was off, and no wind noise was present. FIG. 5*a* shows the downconverted error mic signal upon which the estimates are based, and FIG. 5*b* shows the output of the Kalman Tracker 350, being the estimated tone amplitude. Visual inspection of FIGS. 5*a* and 5*b* perhaps indicates that the earbud was removed at about sample 4000, and then returned onto the ear at about sample 7500, however as can also be seen the process of the user handling the earbud makes these transitions unclear and not instantaneous, particularly the period around samples 7,000 to 8,500 or so.

Figure 5C:
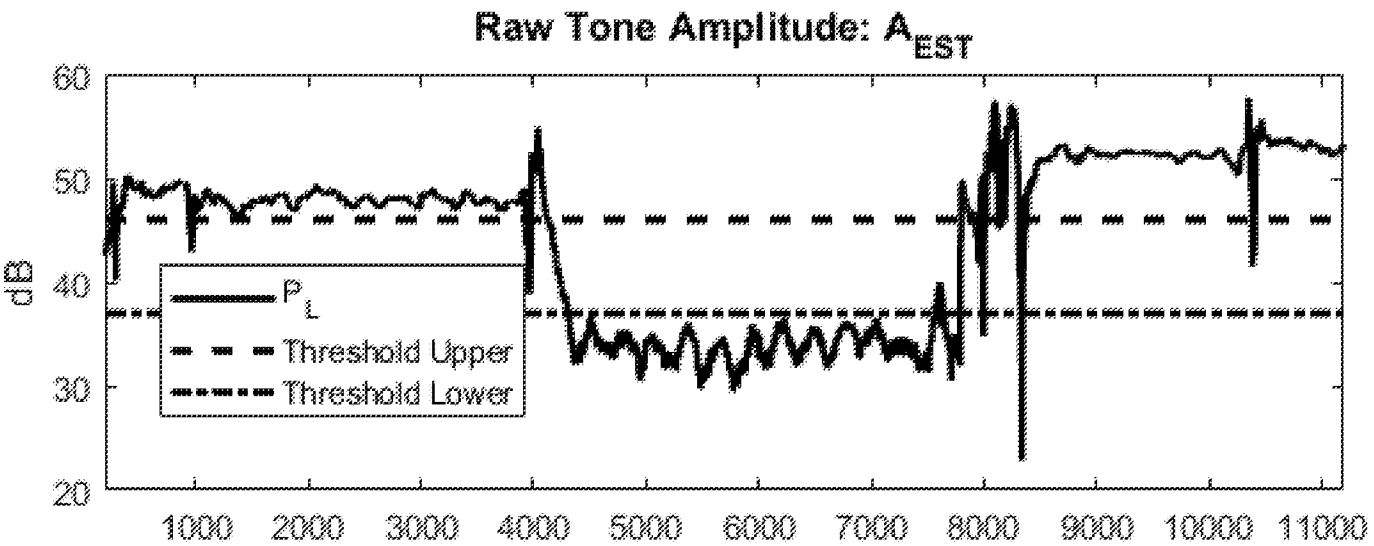

FIG. 5*c* is a plot of the raw tone amplitude estimate produced by the tracker 350. Notably, use of any one threshold as a decision point for whether the headset is on ear or off ear is difficult, as many false positives and/or false negatives will necessarily arise if only one decision threshold is utilised to assess the data of FIG. 5*c*. As shown in FIG. 5*c*, the Kalman Tracker and decision module in this embodiment instead imposes not one detection threshold, but two thresholds, an upper threshold $T_{Upper}$ and a lower threshold $T_{Lower}$. The raw tone amplitude estimate $A_{EST}$ in this embodiment is then divided into $N_D$-sample frames and compared to $T_{Upper}$ and $T_{Lower}$. It is to be noted that the values to which the thresholds $T_{Upper}$ and $T_{Lower}$ are set may vary depending on speaker and mic hardware, headset form factor and degree of occlusion when worn, and the power at which the probe signal is played back, so that selection of suitable such thresholds which fall below an "on ear" amplitude and above an "off ear" amplitude will be an implementation step.

Figure 5D:
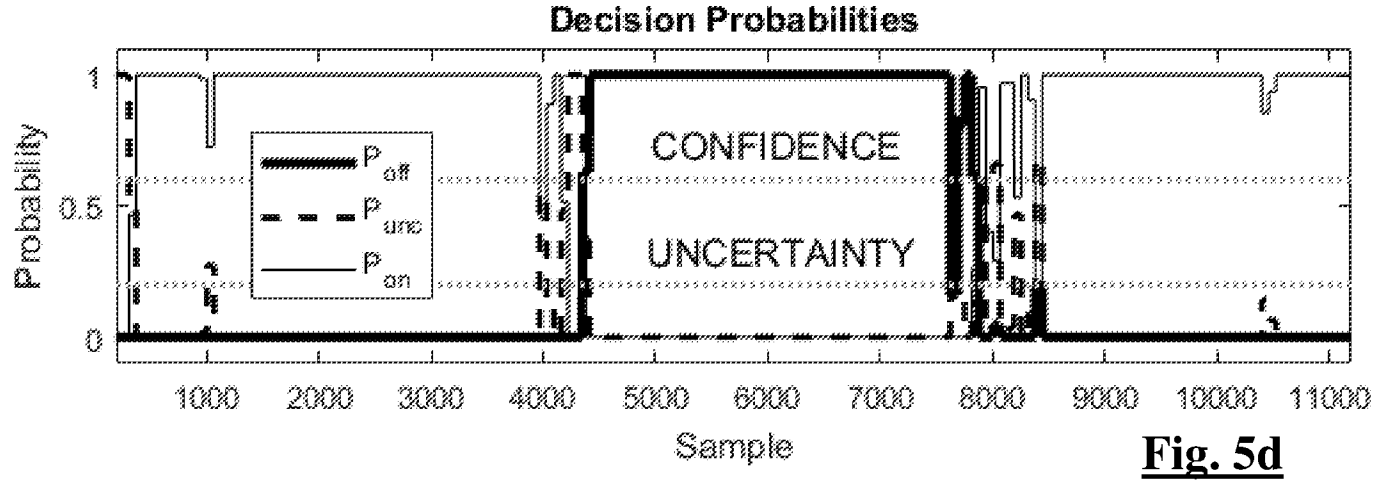
Figure 5E:
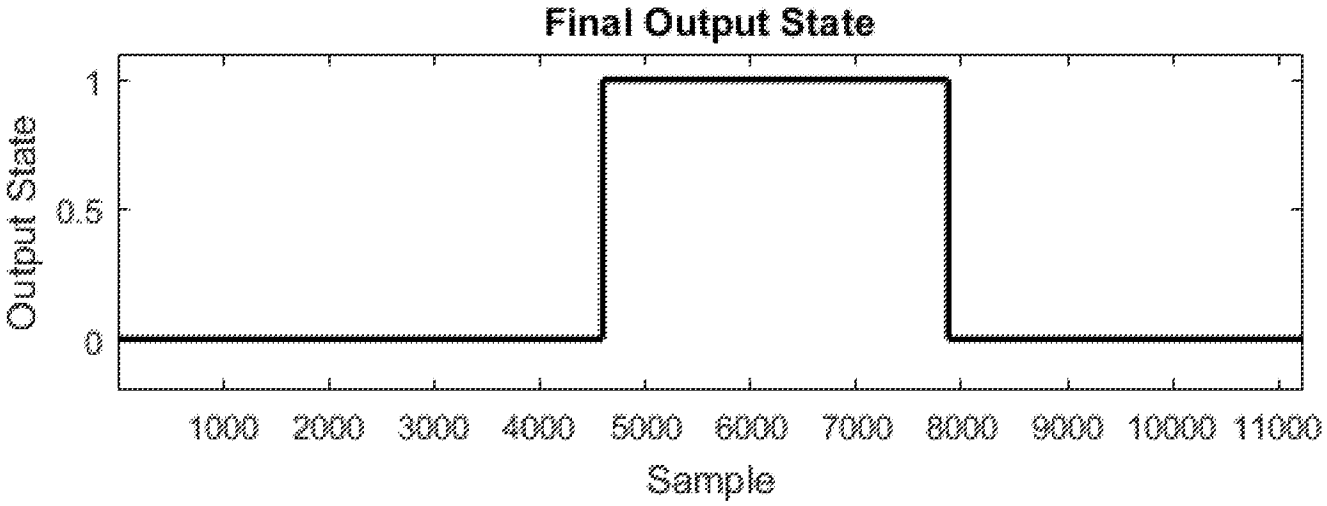

FIG. 5*d* illustrates the application of such a two-threshold Decision Device. Calculations are made as to the probability that the headset is off ear ($P_{OFF}$), the probability that the headset is on ear ($P_{ON}$), and an uncertainty probability ($P_{UNC}$). If $P_{UNC}$ is less than an uncertainty threshold $T_{UNC}$, then the on ear detection decision is updated by comparing $P_{OFF}$ to a confidence threshold $T_{Confidence}$. If $P_{UNC}$ exceeds the uncertainty threshold $T_{UNC}$, then the previous state is retained as there is too much uncertainty to make any new decision. Despite the uncertainty throughout the period around 7,500 samples to 8,500 samples which is evident in FIGS. 5*a*-5*d*, the described approach of this embodiment nevertheless outputs a clean on ear or off ear decision, as shown in FIG. 5*e*. A further refinement of this embodiment is to bias the final decision towards an on ear decision as opposed to an off ear decision, as most DSP functions should be promptly enabled when the device is on ear but can be more slowly disabled when the device goes off ear. To this end, the confidence threshold in FIG. 5*d* is greater than 0.5. Moreover a rule is applied that the state decision is only altered from on ear to off ear if an off ear state is indicated at least a minimum number of times in a row.

Thus, in the embodiment of FIG. 5, $t_D$ is increased in order to span a window of multiple points of data, to reduce volatility associated with instantaneous (sample-to-sample) decisions, noting that a user cannot possibly alternate the position of a headset at a rate which even approaches the sampling rate. Also, it is notable that two thresholds are considered to improve a confidence of on ear or off ear decisions and to create an intermediate "not sure" state which is useful to disable on ear state decision changes when confidence is low. That is, a degree of confidence is introduced, so that the output state indication is changed only if the confidences are sufficient to do so, and repeatedly over time, which introduces some hysteresis into the output indication, reducing volatility in the output as is clear in FIG. 5*e*.

The algorithm applied to effect the process illustrated in FIG. 5 is as follows. First, incoming estimated tone amplitudes, $A_{EST}$, are conditionally sub-divided into frames of $N_D$ samples each, such that $N_D=t_D*F_S$, where $F_S$ is the sampling frequency after down conversion (e.g. 125 Hz). Then, each of the $N_D$ amplitude estimates are compared to two predefined thresholds, $T_{Upper}$ and $T_{Lower}$, to produce three probabilities: $P_{ON}$, $P_{OFF}$, and $P_{UNC}$ (probability of headphone being on ear, probability of headphone being off ear, and probability of being in an uncertain state, respectively) as follows:

a. If $A_{EST}<T_{Lower}$, increment off-ear counter, $N_{OFF}$
b. If $A_{EST}>T_{Upper}$, increment on-ear counter, $N_{ON}$
c. If $A_{EST}>=T_{Lower}$ AND $A_{EST}<=T_{Upper}$, increment uncertainty counter, $N_{UNC}$
d. After all $N_D$ samples have been processed, estimate the probabilities: $P_{OFF}=N_{OFF}/N_D$; $P_{ON}=N_{ON}/N_D$; $P_{UNC}=N_{UNC}/N_D$, so that the probabilities are updated every $N_D$ samples (or, equivalently, $t_D$ seconds).

If the uncertainty probability is low (lower than a predefined threshold, $T_{UNC}$) such that $P_{UNC}<T_{UNC}$, then the on ear decision is updated as follows, where low $P_{UNC}$ represents reliable estimates:

a. If $P_{OFF}>=T_{Conf}$, DECISION=OFF-EAR ("1"), where $T_{Conf}$ is a pre-defined confidence level
b. If $P_{OFF}<T_{Conf}$, DECISION=ON-EAR ("0")

If the uncertainty probability is high (higher than a predefined threshold, $T_{UNC}$) such that $P_{UNC}c>=T_{UNC}$, the on ear decision made at the previous decision interval, $t_D$, is retained. High $P_{UNC}$ represents unreliable estimates (as may arise due to low SNR caused by loose fit or high levels of low frequency noise).

The produced on ear decision is further biased towards being on ear if uncertain. To this end, only one "positive" decision (DECISION==ON-EAR) is sufficient to switch from off-ear to in-ear state. This means that decision latency in this case is exactly $t_D$ seconds. However, M consecutive "positive" decisions (e.g. 4) are necessary to transition from on ear state to off ear state. This means that latency for this case is at least $M*t_D$ seconds. Thus, if DECISION==ON-EAR, then pass it to the output of the detector as is. If DECISION==OFF-EAR, a corresponding counter, $C_{OFF}$ is incremented. If during M decision intervals DECISION is not equal to OFF-EAR, $C_{OFF}$ is reset. DECISION==OFF-EAR is only passed to the output if $C_{OFF}$==M.

On ear detection in accordance with any embodiment of the invention may be performed independently for each ear. The produced decisions may then be combined into an overall decision (e.g. by ANDing decisions made for left and right channels).

The above described embodiments have been shown to perform well at the task of on ear detection, particularly if there exists considerable occlusion from inside the ear canal to the exterior environment, as in such cases a high probe-to-noise ratio exists in the error mic signal.

On the other hand, the following embodiment of the invention may be particularly suitable for headset form factors in which occlusion is poor, as for example may occur for poor headset design, different user anatomy, improper positioning, use of an improper tip on an earbud. The following embodiment may additionally or alternatively be suitable when there exists high levels of low frequency noise. These scenarios effectively reflect a reduced SNR (which in this context, refers to the probe-to-noise ratio). The SNR can decrease "from above", in the sense that less probe signal is received by the detector, and/or can decrease "from below" when a high amount of low frequency noise degrades the SNR. The following embodiment addresses such scenarios by implementing the Kalman state tracker within a closed loop control system.

Figure 6:
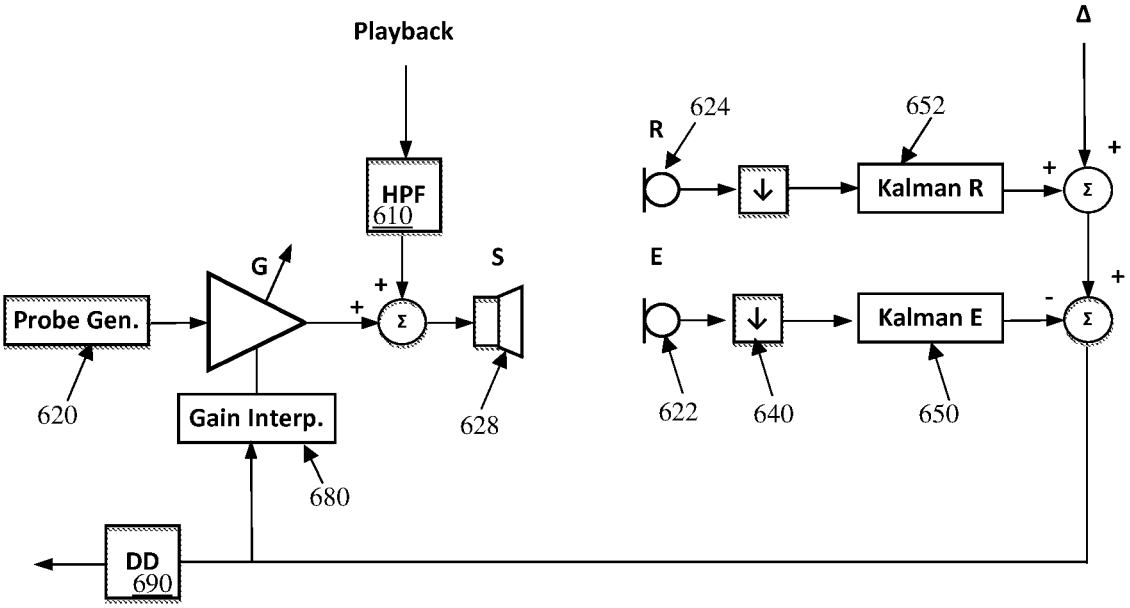
FIG. 6 is a block diagram of an on ear detector in accordance with another embodiment of the invention, implementing dynamic control of the probing signal.

FIG. 6 is a block diagram of another embodiment of an on ear detector, which in particular allows dynamic control over the magnitude of the probe signal in response to poor occlusion and/or high noise. Specifically, the on ear detector of FIG. 6 comprises a closed-loop control system where a level of the probe signal is dynamically changed in order to compensate for the effects of poor occlusion.

In FIG. 6, the speaker S 628, emits a probe signal at a nominal (loud) level in order to maintain a nominal sound level at the error microphone 622. The probe signal is produced by generator 620 and mixed with playback audio, high-pass filtered by HPF 610 to remove (inaudible) frequency content which occupies the same frequency band as the probe signal. It should be noted that the mixing is done at the playback audio's sampling rate. The probe signal mixed with the audio playback content is played by speaker 628 and captured by the error microphone E 622, down sampled in the down converter ↓ module 640 to a lower sampling rate. This has the effect that the playback content is largely removed from the error microphone signal. The level of the probing signal generated at the error microphone is estimated and tracked by the "Kalman E" amplitude tracker 650.

Upon detecting occlusion, i.e. an increase in the error microphone 622 signal level, the level of the probe signal from generator 620 is dynamically reduced by applying a gain G. The gain, G, is calculated and interpolated in the Gain Interp module 680, and is used to control the level of the probe signal at the speaker S 628 in order to maintain the desired level at the error microphone E 622. G is also used by a decision device, DD 690, as a metric to assist in making a decision on whether the earphone is on ear or off ear. If the gain G goes low (large negative number), an on ear state is indicated and/or output.

This embodiment further recognises that a false positive (being the case where the decision device 690 indicates that the headphone is on ear, when in fact the headphone is off ear) is likely to occur overly often if only the error microphone 622 signal is used for detection. This is because when the error microphone 622 signal level increases due to in-band ambient noise (which is not indicative of an on ear state), it can have the same effect on the detector as occlusion (which is indicative of an on ear state), causing a false positive. Accordingly, in the embodiment of FIG. 6 this problem is addressed by making use of the reference microphone 624 for the purpose of determining whether or not an increase in the error microphone 622 signal level is due to occlusion.

When there is in-band ambient noise, the reference microphone R 624 will suffer the same (or within some range, Δ) increase in noise level as the error microphone, E 622. Accordingly, an additional Kalman state tracker, Kalman R 652, is provided to track the reference microphone 624 signal level. The gain, G, can then be increased to amplify the probe signal (up to a maximum level) in order to compensate for in-band noise and to thus maintain SNR within a range necessary for reliable detection. This is implemented by simultaneously tracking the probe signal levels at both the error microphone E 622 and the reference microphone R 624. In turn, the decision device 690 reports that the headphone is on ear when the gain G applied to the probe at the speaker provides $P_{ERR}>P_{REF}+\Delta$, where $P_{ERR}$ is the tracked probe level at the error microphone 622, $P_{REF}$ is the tracked probe level at the reference microphone 624, and Δ is a pre-defined constant. If this condition is not met and the speaker 628 reaches its maximum, the decision device 690 reports that the headphone is off ear.

Figure 7:
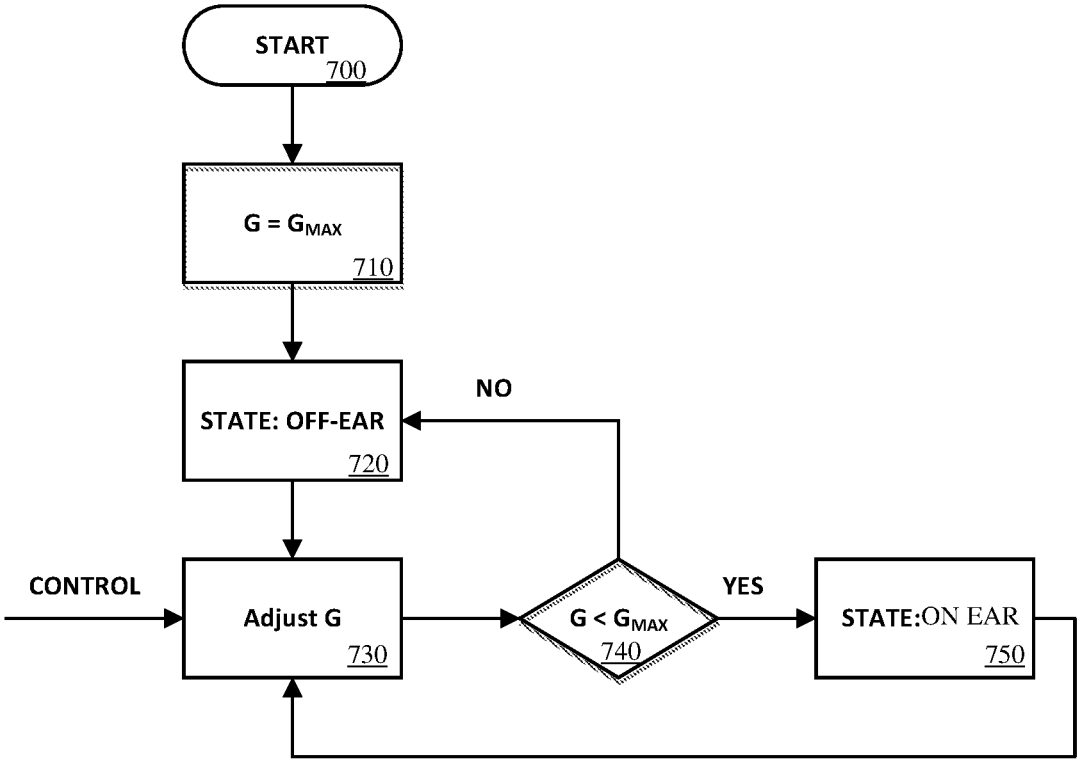
FIG. 7 is a flowchart illustrating dynamic control of the probing signal in the embodiment of FIG. 6.

FIG. 7 is a flowchart further illustrating the embodiment of FIG. 6. The OED of FIG. 7 starts at 700 in the off-ear state which corresponds to radiating the nominal level of the probing signal, by setting the gain G to $G_{MAX}$ at 710 and setting the decision state to off ear at 720. The process then continues to 730 where a "CONTROL" signal, which contains the difference between the reference microphone signal (plus constant offset Δ) and the error microphone signal, is used to adjust the gain G as described above. At step 740, G is compared to $G_{MAX}$. If the adjusted gain output by step 730 is smaller than the maximum gain, $G_{MAX}$, then at 750 the decision is updated to indicate that the headset is on ear. Otherwise at 720 the decision is updated to indicate that the headset is off ear.

In another embodiment similar to FIG. 6, the level of the probe signal at the speaker may serve as a detection metric. This exploits the observation that the lower the level of the probe signal at the speaker, the more likely the headphone is on ear. Such other embodiments of the present invention may thus provide a further Kalman filter, "Kalman S" to track the level of the probing signal at the speaker, S, for this purpose.

Still further embodiments of the invention may provide for averaged or smoothed hysteresis in changing the decision of whether the headset is on ear or off ear. This may be applied to single threshold embodiments such as DD 360, or to multiple threshold embodiments such as the embodiment shown in FIG. 5. In particular, in such further embodiments the hysteresis may for example be effected by providing that only after the decision device indicates that the headset is on ear for more than 1 second is the state indication changed from off ear to on ear. Similarly, only after the decision device indicates that the headset is off ear for more than 3 seconds is the state indication changed from on ear to off ear. The time periods of 1 second and 3 seconds are suggested here for illustrative purposes only and may instead take any other suitable value within the scope of the present invention.

Preferred embodiments also provide for automatic turn off of the OED 130 once the headset has been off ear for more than 5 minutes (or any suitable comparable period of time). This allows OED to provide a useful role when the headsets are in regular use and regularly being moved on ear, but also allows the headset to conserve power when off ear for long periods, after which the OED 130 can be reactivated when the device is next powered up or activated for playback.

Embodiments of the invention may comprise a USB headset having a USB cable connection effecting a data connection with, and effecting a power supply from, a master device. The present invention, in providing for on ear detection which requires only acoustic microphone(s) and acoustic speaker(s), may be particularly advantageous in such embodiments, as USB earbuds typically require very small componentry and have a very low price point, motivating the omission of non-acoustic sensors such as capacitive sensors, infrared sensors, or optical sensors. Another benefit of omitting non-acoustic sensors is to avoid the requirement to provide additional data and/or power wires in the cable connection which must otherwise be dedicated to such non-acoustic sensors. Providing a method for in-ear detection which does not require non-acoustic components is thus particularly beneficial in this case.

Other embodiments of the invention may comprise a wireless headset such as a Bluetooth headset having a wireless data connection with a master device, and having an onboard power supply such as a battery. The present invention may also offer particular advantages in such embodiments, in avoiding the need for the limited battery supply to be consumed by non-acoustic on ear sensor componentry.

The present invention thus seeks to address on ear detection by acoustic means only, that is by using the extant speaker/driver, error microphone(s) and reference microphone(s) of a headset.

Knowledge of whether the headset is on ear can in a simple case be used to disable or enable one or more signal processing functions of the headset. This can save power. This can also avoid the undesirable scenario of a signal processing function adversely affecting device performance when the headset is not in an expected position, whether on ear or off ear. In other embodiments, knowledge of whether the headset is on ear can be used to revise the operation of one or more signal processing or playback functions of the headset, so that such functions respond adaptively to whether the headset is on ear.

It will be appreciated by persons skilled in the art that numerous variations and/or modifications may be made to the invention as shown in the specific embodiments without departing from the spirit or scope of the invention as broadly described.

For example, while in the described embodiments the state tracker is based on a Kalman filter used as an amplitude estimator/tracker, other embodiments within the scope of the present invention may alternatively, or additionally, use other techniques for state estimation to estimate the acoustic coupling of the probe signal from the speaker to the microphone, such as a H∞ (H infinity) filter, nonlinear Kalman filter, unscented Kalman filter, or a particle filter.

The present embodiments are, therefore, to be considered in all respects as illustrative and not restrictive.

The skilled person will thus recognise that some aspects of the above-described apparatus and methods, for example the calculations performed by the processor may be embodied as processor control code, for example on a non-volatile carrier medium such as a disk, CD- or DVD-ROM, programmed memory such as read only memory (firmware), or on a data carrier such as an optical or electrical signal carrier. For many applications, embodiments of the invention will be implemented on a DSP (Digital Signal Processor), ASIC (Application Specific Integrated Circuit) or FPGA (Field Programmable Gate Array). Thus the code may comprise conventional program code or microcode or, for example, code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

Embodiments of the invention may be arranged as part of an audio processing circuit, for instance an audio circuit which may be provided in a host device. A circuit according to an embodiment of the present invention may be implemented as an integrated circuit.

Embodiments may be implemented in a host device, especially a portable and/or battery powered host device such as a mobile telephone, an audio player, a video player, a PDA, a mobile computing platform such as a laptop computer or tablet and/or a games device for example. Embodiments of the invention may also be implemented wholly or partially in accessories attachable to a host device, for example in active speakers or headsets or the like. Embodiments may be implemented in other forms of device such as a remote controller device, a toy, a machine such as a robot, a home automation controller or the like.

It should be noted that the above-mentioned embodiments illustrate rather than limit the invention, and that those skilled in the art will be able to design many alternative embodiments without departing from the scope of the appended claims. The use of "a" or "an" herein does not exclude a plurality, and a single feature or other unit may fulfil the functions of several units recited in the claims. Any reference signs in the claims shall not be construed so as to limit their scope.

The invention claimed is:

1. A method for on ear detection for a headset, the method comprising:

generating a probe signal for acoustic playback from a speaker, wherein the probe signal is confined to a frequency range which is inaudible;

receiving a feedback signal from a feedback microphone, the feedback microphone signal comprising at least a portion of the probe signal as received at the feedback microphone;

applying state estimation to the feedback microphone signal to produce an estimate of at least one parameter of the portion of the probe signal contained in the feedback microphone signal, and determining from the estimate of the at least one parameter whether the headset is on ear;

wherein a level of the probe signal is dynamically reduced upon detection of an increase in a level of the feedback microphone signal.

2. The method of claim 1 wherein determining whether the headset is on ear comprises comparing the estimated parameter to a threshold and wherein the at least one parameter is an amplitude of the probe signal.

3. The method of claim 1 further comprising indicating that the headset is on ear when the amplitude is above a threshold.

4. The method of claim 1 wherein the probe signal comprises a single tone or a weighted multitoned signal.

5. The method of claim 1 wherein the probe signal is confined to a frequency range which is inaudible.

6. The method of claim 1 wherein the probe signal is varied over time or in response to a changed level of ambient noise in the frequency range of the probe signal.

7. The method of claim 1 wherein the applying state estimation is effected by a Kalman filter, and wherein a copy of the probe signal is passed to a predict module of the Kalman filter.

8. The method of claim 1 comprising generating from the at least one parameter a first probability that the headset is on ear and a second probability that the headset is off ear, and using the first probability or the second probability to determine whether the headset is on ear.

9. The method of claim 1 wherein changes in the determination as to whether the headset is on ear are made with a first decision latency from off ear to on ear, and are made with a second decision latency from on ear to off ear, the first decision latency being less than the second decision latency so as to bias the determination towards an on ear determination.

10. A signal processing device for on ear detection for a headset, the device comprising:

a probe signal generator configured to generate a probe signal for acoustic playback from a speaker, wherein the probe signal is confined to a frequency range which is inaudible;

an input for receiving a feedback microphone signal from a feedback microphone, the feedback microphone signal comprising at least a portion of the probe signal as received at the feedback microphone; and a processor configured to generate a noise cancellation signal based at least in part on the probe signal received at the feedback microphone and configured to apply state estimation to the feedback microphone signal to produce an estimate of at least one parameter of the portion of the probe signal contained in the feedback microphone signal, the processor further configured to process the estimate of the at least one parameter to determine whether the headset is on ear;

wherein the processor is configured to cause a level of the probe signal to be dynamically reduced upon detection of an increase in a level of the feedback microphone signal.

11. The device of claim 10 wherein the processor is configured to process the estimate of the at least one parameter to determine whether the headset is on ear by comparing the estimated parameter to a threshold.

12. The device of claim 10 wherein the at least one parameter is an amplitude of the probe signal and wherein when the amplitude is above a threshold the processor is configured to indicate that the headset is on ear.

13. The device of claim 10 wherein the probe signal comprises a single tone or a weighted multitoned signal.

14. The device of claim 10 wherein the probe signal is confined to a frequency range which is inaudible.

15. The device of claim 10 wherein the probe signal is varied over time or in response to a changed level of ambient noise in the frequency range of the probe signal.

16. The device of claim 10 wherein the processor is configured to implement a Kalman filter and wherein a copy of the probe signal generated by the probe signal generator is passed to a predict module of the Kalman filter.

17. The device of claim 10 comprising a decision device module configured to generate from the at least one parameter a first probability that the headset is on ear, and a second probability that the headset is off ear, and wherein the processor is configured to use the first probability and/or the second probability to determine whether the headset is on ear.

18. The device of claim 10 wherein changes in the determination as to whether the headset is on ear are made with a first decision latency from off ear to on ear, and are made with a second decision latency from on ear to off ear, the first decision latency being less than the second decision latency so as to bias the determination towards an on ear determination.

19. A non-transitory computer readable medium for on ear detection for a headset, comprising instructions which, when executed by one or more processors, causes performance of the following:

generating a probe signal for acoustic playback from a speaker, wherein the probe signal is confined to a frequency range which is inaudible;

receiving a feedback microphone signal from a feedback microphone, the feedback microphone signal comprising at least a portion of the probe signal as received at the feedback microphone;

applying state estimation to the feedback microphone signal to produce an estimate of at least one parameter of the portion of the probe signal contained in the feedback microphone signal, and determining from the estimate of the at least one parameter whether the headset is on ear;

wherein a level of the probe signal is dynamically reduced upon detection of an increase in a level of the feedback microphone signal.

20. A system for on ear detection for a headset, the system comprising a processor and a memory, the memory containing instructions executable by the processor and wherein the system is operative to:

generate a probe signal for acoustic playback from a speaker, wherein the probe signal is confined to a frequency range which is inaudible;

receive a feedback microphone signal from a feedback microphone, the feedback microphone signal comprising at least a portion of the probe signal as received at the feedback microphone;

apply state estimation to the feedback microphone signal to produce an estimate of at least one parameter of the portion of the probe signal contained in the feedback microphone signal, and determine from the estimate of the at least one parameter whether the headset is on ear;

wherein a level of the probe signal is dynamically reduced upon detection of an increase in a level of the feedback microphone signal.

* * * * *